United States Patent [19]

Tokuhara

[11] Patent Number: 4,588,283

[45] Date of Patent: May 13, 1986

[54] ELECTROPHOTOGRAPHIC COPYING APPARATUS WITH ORIGINAL LIGHT DETECTOR

[75] Inventor: Mitsuhiro Tokuhara, Chigasaki, Japan

[73] Assignee: Canon Kabushiki Kaisha, Tokyo, Japan

[21] Appl. No.: 674,718

[22] Filed: Nov. 26, 1984

Related U.S. Application Data

[63] Continuation of Ser. No. 507,582, Jun. 24, 1983, abandoned.

[30] Foreign Application Priority Data

Jul. 5, 1982 [JP] Japan ..... 57-116449

[51] Int. Cl.[4] ..... G03G 15/00

[52] U.S. Cl. ..... 355/14 E; 355/14 D; 355/68

[58] Field of Search ..... 355/14 E, 14 D, 14 R, 355/3 R, 68, 69

[56] References Cited

U.S. PATENT DOCUMENTS

| | | | |
|---|---|---|---|
| 3,926,518 | 12/1975 | Berry et al. | 355/8 |
| 4,153,364 | 5/1979 | Suzuki et al. | 355/14 D |
| 4,200,391 | 4/1980 | Sakamoto et al. | 355/14 D |
| 4,354,758 | 10/1982 | Futaki et al. | 355/14 |

FOREIGN PATENT DOCUMENTS

| | | |
|---|---|---|
| 48-3871873 | 6/1973 | Japan . |
| 50-4285675 | 4/1975 | Japan . |
| 54-3672579 | 8/1979 | Japan . |
| 56-10727081 | 1/1981 | Japan . |

*Primary Examiner*—A. C. Prescott
*Assistant Examiner*—David Warren
*Attorney, Agent, or Firm*—Fitzpatrick, Cella, Harper & Scinto

[57] ABSTRACT

An electrophotographic copying apparatus includes a light receiving element disposed to receive beams of light from the central and lateral end portions of an original to be copied through a lens, the output signal of the light receiving element being used to control a copy image with respect to its darkness.

24 Claims, 4 Drawing Figures

ELECTROPHOTOGRAPHIC COPYING APPARATUS WITH ORIGINAL LIGHT DETECTOR

This application is a continuation of application Ser. No. 507,582 filed June 24, 1983, now abandoned.

BACKGROUND OF THE INVENTION

1. Field of the Invention

The present invention relates to an electrophotographic apparatus, and particularly to an electrophotographic apparatus capable of controlling the darkness of a copied image in connection with that of an original.

2. Description of the Prior Art

In such an electrophotographic apparatus, a light receiving element is used to receive light from an original to be copied and to generate a signal corresponding to the amount of received light. This signal is used to control the copied image with respect to its darkness. Thus, the copied image will have proper darkness in connection with the darkness in the original.

Japanese Laid-open Patent Application No. 42856/1975 which corresponds to U.S. Pat. No. 3,926,518 discloses such a light receiving element which is disposed on a slitted plate located adjacent to a photosensitive member. Japanese Laid-open Patent Application No. 38718/1973 discloses a light receiving element located across the optical path of a light beam which has been split from an imaging light beam by a half mirror and transmitted through the same, or a light receiving element which is disposed to receive a light from an original through a lens other than an imaging lens through which the original is imaged on a photosensitive member. In these prior art arrangements, the darkness of only a portion of the original can be detected so that the detected information will not match the information of darkness in the overall surface of the original. If the information of darkness in the overall surface of the original is required, an elongated light receiving element or a plurality of light receiving elements must be used resulting in various disadvantages such as an increased cost and others.

Japanese Laid-open Patent Application No. 36725/1979 which corresponds to U.S. Pat. No. 4,200,391 discloses a light receiving element located adjacent to an original placing plate. This arrangement also requires a plurality of light receiving elements if the information must be taken throughout a slit. Further, an additional illuminating device other than the exposure illumination system is required resulting in a complicated structure. Japanese Laid-open Patent Application No. 107270/1981, which corresponds to U.S. Pat. No. 4,354,758 discloses a light receiving element which is disposed behind a lens, in which, however, there is no disclosure as to the part of the original from which the light is received by the light receiving element.

SUMMARY OF THE INVENTION

It is an object of the present invention to provide an electrophotographic copying machine which does not have the above-mentioned disadvantages.

Another object of the present invention is to provide an electrophotographic copying machine for detecting the information of darkness substantially over the whole width of an original to be copied to control a copied image with respect to its darkness.

Further object of the present invention is to provide an electrophotographic copying machine which can control the darkness of a copied image by the use of a simplified structure for detecting the darkness of an original to be copied.

Other objects and features of the present invention will be apparent from the following description in connection with the accompanying drawings.

DESCRIPTION OF THE PREFERRED EMBODIMENTS

Figure 1:
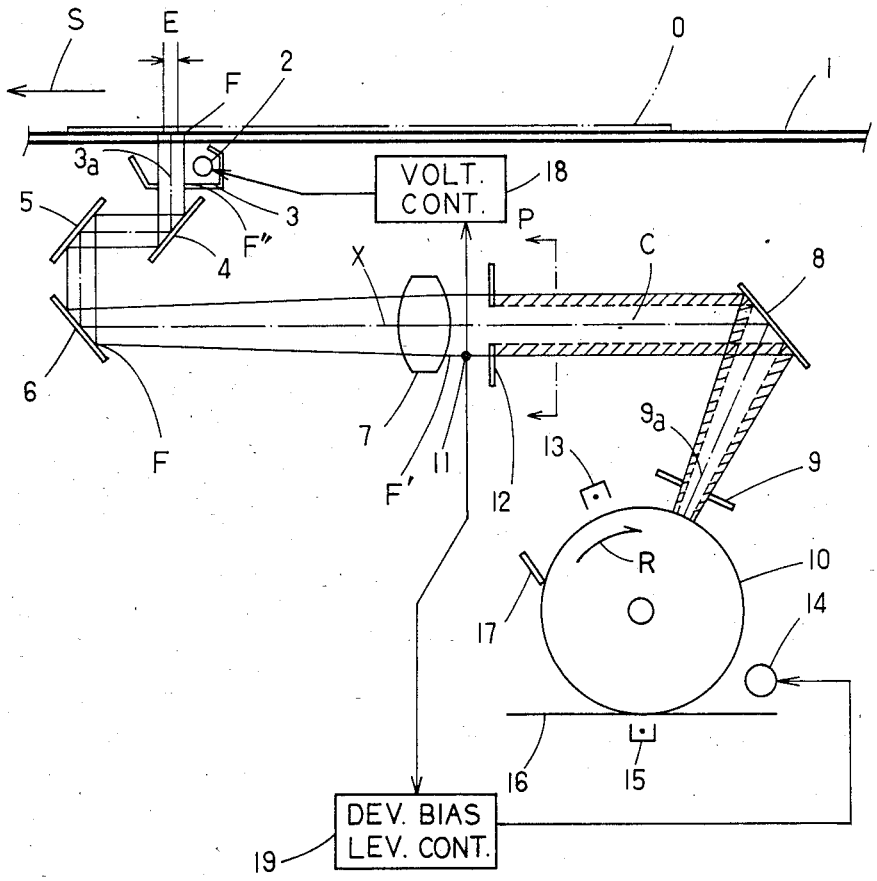
FIG. 1 illustrates one embodiment of the present invention.

FIG. 1 shows an original O carried on a transparent platen glass 1 and illuminated by a lamp 2. Light reflected by the original O is incident on a mirror 4 through a slit-like opening 3*a* which is provided substantially just below the platen glass 1. The slit-like opening 3*a* is formed in a reflecting plate 3 adapted to reflect the light from the lamp 2 toward the original O. The opening 3*a* extends in the direction perpendicular to the direction of original scanning which will be described hereinafter, that is, perpendicular to the plane including this drawing. The light beam C, which has been incident on the mirror 4 from the original O through the slit-like opening 3*a*, is acted sequentially by a mirror 5, mirror 6, lens 7 and mirror 8 and incident on an electrophotographic photosensitive member 10 in the form of a drum. Thus, the photosensitive member 10 is exposed to the light image of the original O through the slit.

The platen glass 1 is moved by well-known drive means in a direction shown by an arrow S in which the original will be scanned. This direction will be called "the direction of original scanning" hereinafter. On scanning an original, the original O is illuminated by the lamp 2 to form its light image which is in turn imaged on the photosensitive member 10 through the lens 7. On termination of scanning, the platen glass 1 is moved by the drive means in the direction opposite to the direction S to return its original position.

The photosensitive member 10 is rotated in a direction shown by an arrow R. The photosensitive member 10 is charged by a charger 13 in a charging station. In an exposure station, the photosensitive member 10 is exposed to the light image of the original through the slit-like opening 9*a* of a slitted plate 9, which opening 9*a* extends in the direction perpendicular to the rotational direction of the photosensitive member 10, that is, in the direction perpendicular to the direction of original scanning. Thus, an electrostatic latent image of the original is formed on the photosensitive member 10. In a development station, this latent image is developed by means of a development device 14 which applies a developer (toner) to the photosensitive member 10. The toner image thus formed is then transferred to paper 16 by a transfer charger 15 in an image transfer station. The paper 16 is then fed to well-known fixing means wherein the toner image is fixed to the paper 16. After the transferring step, the photosensitive member 10 is cleaned by a cleaning blade 17 in a cleaning station. Any one of the slit-like openings 3*a* and 9*a* may be omitted.

Figure 3:
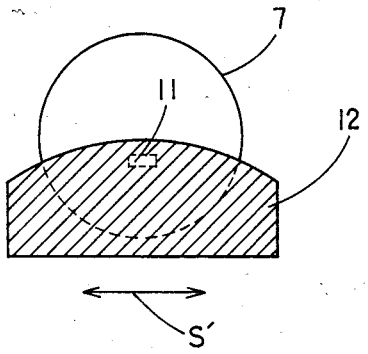
FIG. 3 is a schematic diagram of an exemplified portion as viewed along an arrowed line P—P in FIG. 1.
Figure 4:
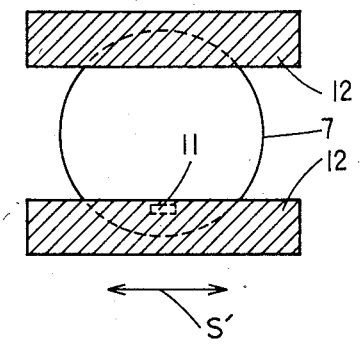
FIG. 4 is a schematic diagram of another exemplified portion as viewed along the arrowed line P—P in FIG. 1.

Between the lens 7 and the mirror 8 there is disposed a plate 12 for correcting the distribution of light amount, which plate is located across the optical path. This correcting plate 12 is positioned adjacent to the exit face of the lens 7 and adapted to block a portion of the light beam exiting the lens 7. This blocked light beam portion is depicted by a hatched area in FIG. 3. The inner edge of the correcting plate 12 may be contoured by an arcuate line as shown in FIG. 3 or any other curved lines. In the arrangement shown in FIG. 3, there is provided a single correction plate 12. On the contrary, an arrangement shown in FIG. 4 includes two such correcting plates. These correcting plates 12 have straight edge opposed to each other to form an opening of light passage therebetween. In any event, each correcting plate functions to block a portion of the light beam exiting the lens 7 for correcting the distribution of light amount on the photosensitive member 10 in the direction perpendicular to the rotational direction R thereof, that is, in the direction normal to the direction of original scanning. The distribution of light amount on the photosensitive member 10 can be thus equalized in the direction perpendicular to the direction of original scanning irrespectively of $Cos^4$ law for the lens 7. In FIGS. 3 and 4, the direction S' is the direction perpendicular to the direction of original scanning S.

A light receiving element 11 is made of a solar battery, Cds or the like and receives the light from the lens 7 to generate an output signal corresponding to the amount of light which has been received by the light receiving element 11. The light receiving element 11 is located in the optical path between the lens 7 and the correcting plate 12 and is disposed in such a position that the light receiving element 11 does not block any light to be directed to the photosensitive member 10. Therefore, the image of the light receiving element 11 will not be projected on the photosensitive member 10 and will not disturb the copied image of the original. In the embodiment shown in FIG. 1, the light receiving element 11 is disposed at such a position that it is across the path of that portion F' of the light beam from the lens 7 which will be blocked by the correcting plate 12 and at the same time at a position spaced apart from the optical axis X of the lens 7. In FIG. 1, the light receiving element 11 is shown as being spaced apart from the correction plate 12, but it may be mounted on the correction plate 12. The light beam F' is the one which has travelled from the position F of the original and passes by the forward edge F'' of the slit-like opening 3*a*. The above position F is immediately before a position E, at which the photosensitive member 10 starts to be exposed to the image. In other words, the light receiving element 11 is adapted to receive the light from that portion of the original to which the photosensitive member is about being exposed through the slit-like opening 3*a*. Thus, each portion of the original O will be detected by the light receiving element 11 with respect to darkness before they are projected onto the photosensitive member 10. A signal corresponding to the detected area of the original is generated in the light receiving element 11 and applied to a voltage control circuit 18 which in turn controls a voltage to be applied to the lamp 2 in connection with the above signal. Thus, light radiating from the lamp 2 is controlled in amount in association with the darkness of each area in the original. In other words, if an area on the original is higher in darkness, the light emitted from the lamp 2 is correspondingly increased in amount. The control circuit 18 includes a delay circuit by which a voltage corresponding to the generated signal is applied to the lamp 2 with a predetermined time delay from the generation of the same signal in the light receiving element 11. When the area of the original moves from the position F to the position E, the light emitted from the lamp 2 is controlled in amount in accordance with the darkness on this area of the original. If the control of the lamp 2 is carried out by the light from the position E, the amount of the light emitted from the lamp 2 may not properly match the darkness on the area of the original in the position E due to a possible delay of response in the control circuit. However, the embodiment shown in FIG. 1 can avoid such a problem.

Although the above-mentioned embodiment has been described as to control the lamp 2 by the use of the signal from the light receiving element 11, the development device 14 may be controlled by the use of the same signal. In this case, a control circuit (developer bias control means) 19 is provided to control a development bias voltage to be applied to the development device 14 in accordance with a signal generated in the light receiving element 11. By controlling the development bias signal to the development device, it is difficult to deposit the toner on that portion of the electrostatic latent image which corresponds to the area of the original increased in darkness. On the contrary, the toner is easily deposited on the other portion of the electrostatic latent image which corresponds to the other area of the original decreased in darkness. The control circuit 19 also includes a delay circuit by which a bias voltage corresponding to the generated signal is applied to the development device 14 with a predetermined delay of time from the formation of the same signal in the light receiving element 11. For example, when the latent image of the position F of the original reaches the development station, a voltage which matches the darkness of this image area is applied to the development device 14.

One or both of the control circuits 18 and 19 may be used.

In the aforementioned embodiment of the present invention, the photosensitive member 10 is exposed to the image of the original to form a latent image which is in turn developed into a toner image which will be transferred to the transfer sheet 16. And, during this image forming process, the darkness of the original is measured. However, the measurement of darkness may be carried out by the light receiving element 11 when the original is pre-scanned in the direction S or the opposite direction before the image forming process is carried out. In this case, information with respect to the darkness on the original is stored in a memory circuit provided within the control circuit 18 or 19. The stored information of darkness is utilized to control the voltage to the lamp 2 and/or the bias voltage to the development device 14 in the succeeding image forming process. The darkness information to be stored may relate to an average darkness on the original.

Figure 2:
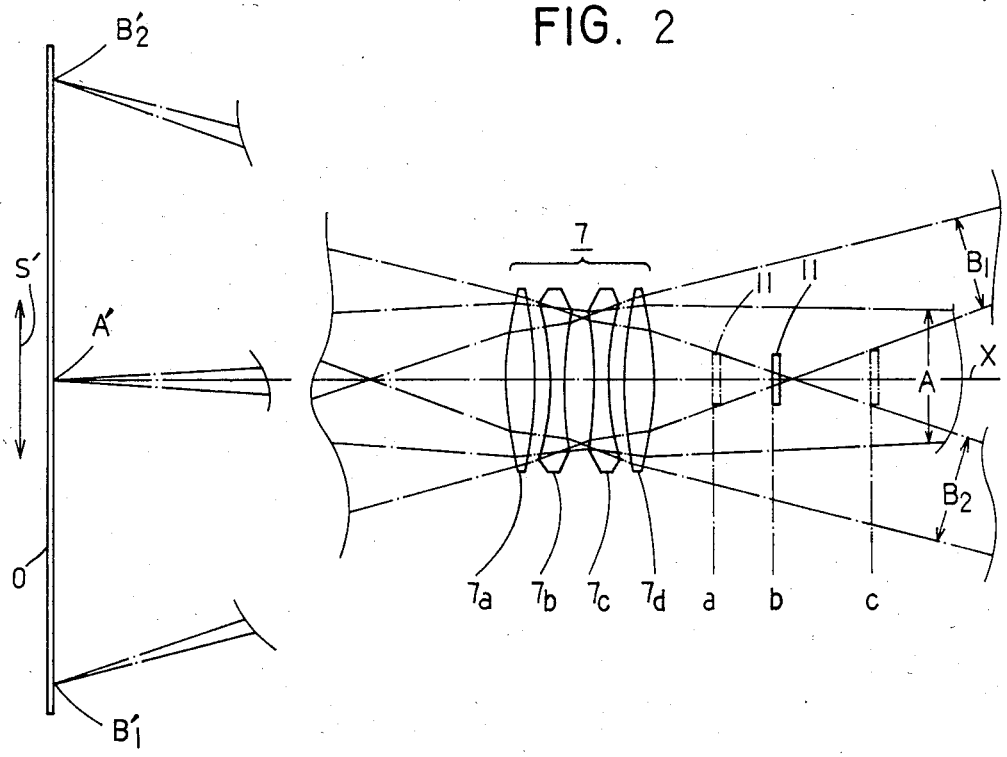
FIG. 2 is a diagram of an optical path, a portion of the optical path being omitted.

As described hereinbefore, the light receiving element 11 is disposed in such a position that a shade thereof is not formed on the photosensitive member 10. The position of the light receiving element 11, i.e. the position in the direction perpendicular to the scanning direction, will be described with reference to FIG. 2. In FIG. 2, the lens system 7 consists of convex lenses *7a*, *7d* and concave lenses *7b*, *7c*. Light from the center A' of the original O, with respect to the direction S' which is perpendicular to the scanning direction S is formed through the lens system 7 into a central light beam A. Lights from the marginal portions $B_1'$ and $B_2'$ of the original O are respectively formed through the lens system 7 into marginal light beams $B_1$ and $B_2$ in the direction S. The light receiving element 11 is located to receive all the light beams A, $B_1$ and $B_2$, that is, between a position shown by letter c in FIG. 2 and the lens system 7. If the light receiving element 11 is disposed at a position shown by letter a, the overall surface thereof receives the light beams A, $B_1$ and $B_2$. This position a is most desirable in that it can more exactly detect the darkness over the whole width of the original. In a position shown by letter b, the light beam A is incident on the light receiving element over the whole surface thereof while the light beams $B_1$ and $B_2$ are incident only on a portion of the light receiving element 11. If the light receiving element 11 is located at a position rearwardly of the position c, the light beams $B_1$ and $B_2$ will not be incident on the light receiving element 11. For this reason, the light receiving element 11 is disposed at a position displaced from the position c toward the lens 7. Thus, the darkness substantially over the whole width of the original O can substantially uniformly be read out by the use of a single light receiving element.

Although the aforementioned embodiments of the present invention have been described as to control the voltage applied to the lamp 2 and/or the bias voltage applied to the development device 14 for controlling the darkness with respect to a copied image, such a control may be carried out by controlling a voltage to be applied to the charger 13, or by providing a diaphragm in the optical path and controlling the opening of the same.

Although the aforementioned embodiments have been described as scanning the original by moving the original placing plate 1, the scanning may be carried out by providing a stationary original placing plate, while moving the lamp 2, reflecting plate 3 and mirror 4 parallel to the stationary original placing plate as a unit, and by moving the mirrors 5 and 6 at half speed relative to that of the mirror 4.

What is claimed is:

1. An electrophotographic copying machine comprising:

means for scanning an original to be copied;

an electrophotographic photosensitive member disposed to pass succeedingly by a charging station, an exposure station and a development station;

means for charging said photosensitive member at the charging station;

optical means for exposing said photosensitive member to a light image of the original at the exposure station, said optical means including means for illuminating the original and lens means for forming the light image of the original on said photosensitive member;

development means for applying a developer to said photosensitive member at the development station;

a single light receiving element for forming a signal corresponding to the amount of light which has been received by said light receiving element, said light receiving element being disposed at such a position as to receive the light from said lens along an optical path between said lens and said photosensitive member and also as to receive first, second and third light beams from the central, one end and the other end portions, respectively, of the original with respect to the direction perpendicular to the direction in which the original is scanned, wherein, at such position, the first light beam from the central portion and the second light beam from the one end portion cross each other and the first light beam and third light beam from the other end portion cross each other; and means for controlling the darkness on a copied image in accordance with the signal from said light receiving element.

2. An electrophotographic copying machine as defined in claim 1 wherein said controlling means is adapted to control the amount of a light radiating from said illuminating means.

3. An electrophotographic copying machine as defined in claim 1 wherein said controlling means is adapted to control a bias voltage applied to said development means.

4. An electrophotogpraphic copying machine as defined in any one of claims 1 to 3 wherein said optical means includes a mirror located across the optical path between said lens means and said photosensitive member and a correction member located across the optical path between said mirror and said lens means for blocking a portion of the light beam from said lens means to correct the distribution of light amount on said photosensitive member in a direction corresponding to the direction perpendicular to the direction in which said original is scanned and wherein said light receiving element is disposed in the optical path between said lens means and said correction member for receiving the light portion blocked by said correction member.

5. An electrophotogprahic copying machine as defined in claim 4 wherein said light receiving element is located off the optical axis of said lens means.

6. A machine according to any one of claims 1–3, wherein said first, second and third light beams are crossed with each other at the position where said light receiving element is disposed.

7. A machine according to any one of claims 1–3, wherein said first and second light beams are crossed, and said first and third light beams are crossed, but said second and third light beams are apart at the position where said light receiving element is disposed.

8. A machine according to claim 6, wherein said light receiving element receives, at such position, the light corresponding to the area immediately before being projected onto said photosensitive member.

9. A machine according to claim 7, wherein said light receiving element receives, at such position, the light corresponding to the area of the original immediately before being projected onto said photosensitive member.

10. An electrophotographic copying machine comprising:

means for scanning an original to be copied;

an electrophotographic photosensitive member disposed to pass succeedingly by a charging station, an exposure station, a development station and a transfer station;

means for charging said photosensitive member at the charging station;

optical means for exposing said photosensitive member to a light image of the original at the exposure station, said optical means including means for illuminating the original and lens means for forming the light image of the original on said photosensitive member;

development means for applying a developer to said photosensitive member at the development station;

transfer means for transferring a developed image to a paper at the transfer station;

a single light receiving means for forming a signal corresponding to the amount of light which has been received by said light receiving means, said light receiving means being disposed at such a position as to receive the light from said lens along an optical path between said lens and said photosensitive member and also as to receive first, second and third light beams from the central, one end and the other end portions, respectively, of the original with respect to the direction perpendicular to the direction in which the original is scanned, wherein at such position, the first light beam from the central portion and the second light beam from the one end portion cross each other and beam the first light beam and third light beam from the other end portion cross each other; and means for controlling the darkness of a copied image in accordance with the signal from said light receiving means.

11. An electrophotographic copying machine as defined in claim 10 wherein said controlling means is adapted to control the amount of a light radiating from said illuminating means.

12. An electrophotographic copying machine as defined in claim 10 wherein said controlling means is adapted to control a bias voltage applied to said development means.

13. An electrophotographic copying machine according to any one of claims 10–12, wherein said light receiving means is located off the optical axis of said lens means.

14. A machine according to claim 13, wherein said first, second and third light beams are crossed with each other at the position where said light receiving means is disposed.

15. A machine according to claim 13, wherein said first and second light beams are crossed, and said first and third light beams are crossed, but said second and third light beams are apart at the position where said light receiving means is disposed.

16. A machine according to claim 13, wherein said light receiving means receives, at such position, the light corresponding to the area immediately before being projected onto said photosensitive member.

17. An electrophotographic copying machine as defined in claim 13, wherein said optical means includes a mirror located across the optical path between said lens means and said photosensitive member and a correction member located across the optical path between said mirror and said lens means for blocking a portion of the light beam from said lens means to correct the distribution of light amount on said photosensitive member in a direction corresponding to the direction perpendicular to the direction in which said original is scanned and wherein said light receiving means is disposed in the optical path between said lens means and said correction member for receiving the light portion blocked by said correction member.

18. An electrophotographic copying machine comprising:

means for scanning an original to be copied;

an electrophotographic photosensitive member disposed to pass succeedingly by a charging station, an exposure station, a development station and a transfer station;

means for charging said photosensitive member at the charging station;

optical means for exposing said photosensitive member to a light image of the original at the exposure station, said optical means including means for illuminating the original and lens means for forming the light image of the original on said photosensitive member;

development means for applying a developer to said photosensitive member at the development station;

transfer means for transferring a developed image to a paper at the transfer station;

light receiving means for forming a signal corresponding to the amount of light which has been received by said light receiving means, said light receiving means being disposed at such a position as to receive the light from said lens along an optical path between said lens and said photosensitive member and also as to receive first, second and third light beams from the central, one end and the other end portions, respectively, of the original with respect to the direction perpendicular to the direction in which the original is scanned, wherein at such position, the first light beam from the central portion and the second beam from the one end portion cross each other and the first light beam and third light from the other end portion cross each other;

means for controlling the darkness of a copied image in accordance with the signal from said light receiving means; and wherein said first, second and third light beams are crossed with each other at the position where said light receiving means is disposed.

19. An electrophotographic copying machine as defined in claim 18 wherein said controlling means is adapted to control the amount of a light radiating from said illumination means.

20. An electrophotographic copying machine as defined in claim 18 wherein said controlling means is adapted to control a bias voltage applied to said development means.

21. An electrophotographic copying machine according to any one of claims 18–20, wherein said light receiving means is located off the optical axis of said lens means.

22. A machine according to claim 21, wherein said first and second light beams are crossed, and said first and third light beams are crossed, but said second and third light beams are apart at the position where said light receiving means is disposed.

23. A machine according to claim 21, wherein said light receiving means receives, at such position, the light corresponding to the area immediately before being projected onto said photosensitive member.

24. An electrophotographic copying machine as defined in claim 21, wherein said optical means includes a mirror located across the optical path between said lens means and said photosensitive member and a correction member located across the optical path between said mirror and said lens means for blocking a portion of the light beam from said lens means to correct the distribution of light amount on said photosensitive member in a direction corresponding to the direction perpendicular to the direction in which said original is scanned and wherein said light-receiving means is disposed in the optical path between said lens means and said correction member for receiving the light portion blocked by said correction member.

* * * * *

UNITED STATES PATENT AND TRADEMARK OFFICE

CERTIFICATE OF CORRECTION

PATENT NO. : 4,588,283

DATED : May 13, 1986

INVENTOR(S) : MITSUHIRO TOKUHARA

It is certified that error appears in the above-identified patent and that said Letters Patent is hereby corrected as shown below:

Column 1, line 24, change "1975 which" to --1975, which--; and line 45, change "1979 which" to --1979, which--.

Column 2, line 3, change "Further" to --A further--; and line 51, change "return its" to --return to its--.

Column 3, line 18, change "edge" to --edges--.

UNITED STATES PATENT AND TRADEMARK OFFICE

CERTIFICATE OF CORRECTION

PATENT NO. : 4,588,283

DATED : May 13, 1986

INVENTOR(S) : MITSUHIRO TOKUHARA

It is certified that error appears in the above-identified patent and that said Letters Patent is hereby corrected as shown below:

Column 6, line 3, change "also as" to --also so as--;

line 24, change "electrophotogpraphic" to --electrophotographic--; and line 38, change "electrophotogprahic" to --electrophotographic--.

Column 7, line 24, change "and beam the" to --and the--.

Column 8, line 45, change "illumination" to --illuminating--.

Signed and Sealed this

Twenty-seventh Day of January, 1987

*Attest:*

DONALD J. QUIGG

*Attesting Officer* *Commissioner of Patents and Trademarks*